US007871055B1

(12) United States Patent
Dagher et al.

(10) Patent No.: US 7,871,055 B1
(45) Date of Patent: Jan. 18, 2011

(54) LIGHTWEIGHT COMPOSITE CONCRETE FORMWORK PANEL

(75) Inventors: Habib J. Dagher, Veazie, ME (US); Ghassan N. Fayad, Cambridge, MA (US); Jonathon E. Kenerson, Levant, ME (US); Matthew S. Giffen, Chelsea, ME (US)

(73) Assignee: University Of Maine System Board Of Trustees, Bangor, ME (US)

( * ) Notice: Subject to any disclaimer, the term of this patent is extended or adjusted under 35 U.S.C. 154(b) by 1298 days.

(21) Appl. No.: 11/409,792

(22) Filed: Apr. 24, 2006

(51) Int. Cl.
*E04G 17/00* (2006.01)
*E04G 11/00* (2006.01)

(52) U.S. Cl. ..... 249/195; 249/47; 52/582.1; 52/802.1; 428/76; 428/113

(58) Field of Classification Search ..... 52/793.11, 52/794.1, 802.1, 800.1; 249/189; 428/113, 428/105, 109, 110, 68, 71, 73, 76
See application file for complete search history.

(56) References Cited

U.S. PATENT DOCUMENTS

| | | | | | |
|---|---|---|---|---|---|
| 839,819 | A * | 1/1907 | Lhorbe | 249/40 |
| 903,456 | A * | 11/1908 | Davis | 312/265.5 |
| 2,296,036 | A * | 9/1942 | Horn | 249/190 |
| 3,168,772 | A * | 2/1965 | Williams | 249/42 |
| 3,381,929 | A * | 5/1968 | Bancker | 249/5 |
| 3,471,984 | A * | 10/1969 | Hayes | 52/309.11 |
| 4,228,625 | A | 10/1980 | Ruffer et al. | |
| 4,820,568 | A * | 4/1989 | Harpell et al. | 428/113 |
| 4,856,754 | A * | 8/1989 | Yokota et al. | 249/113 |
| 4,894,974 | A * | 1/1990 | Mayhew et al. | 52/783.1 |
| 4,937,993 | A * | 7/1990 | Hitchins | 52/455 |
| 5,098,059 | A * | 3/1992 | Sawyer | 249/16 |
| 5,182,996 | A * | 2/1993 | Gutgsell | 108/64 |
| 5,667,866 | A * | 9/1997 | Reese, Jr. | 428/116 |
| 5,792,552 | A * | 8/1998 | Langkamp et al. | 428/309.9 |
| 5,799,399 | A * | 9/1998 | Schultz | 29/897.3 |
| 6,114,003 | A * | 9/2000 | Gottfried | 428/73 |
| 6,865,859 | B2 * | 3/2005 | Flathau | 52/742.14 |
| 2003/0096072 | A1 | 5/2003 | Johnson | |
| 2003/0193007 | A1 * | 10/2003 | Wells | 249/189 |
| 2004/0007656 | A1 | 1/2004 | Seela | |
| 2004/0056172 | A1 * | 3/2004 | Sedran | 249/189 |
| 2004/0213952 | A1 * | 10/2004 | Takemura et al. | 428/105 |

(Continued)

FOREIGN PATENT DOCUMENTS

JP 03227201 * 10/1991

(Continued)

OTHER PUBLICATIONS

International Search Report; International Application No. PCT/US 07/09720.

*Primary Examiner*—Janet M Wilkens
(74) *Attorney, Agent, or Firm*—MacMillan, Sobanski & Todd, LLC

(57) ABSTRACT

A lightweight concrete formwork panel has a wooden rectangular frame with perimeter members and inner ribs that define openings in the frame. A lightweight core material substantially fills the openings in the wooden frame. An outer skin substantially covers the frame. The outer skin has a layer of transversely oriented fibrous material and a layer of longitudinally oriented fibrous material.

17 Claims, 8 Drawing Sheets

U.S. PATENT DOCUMENTS

2005/0229536 A1* 10/2005 Yoshii et al. ..... 52/783.11
2005/0257478 A1* 11/2005 Callinan ..... 52/576
2005/0266222 A1 12/2005 Clark et al.
2005/0284089 A1 12/2005 Groothuis
2007/0228254 A1* 10/2007 England ..... 249/114.1
2008/0118735 A1* 5/2008 Kanao ..... 428/294.7
2008/0128030 A1* 6/2008 Lewis ..... 137/265

FOREIGN PATENT DOCUMENTS

JP 09203068 * 8/1997

* cited by examiner

LIGHTWEIGHT COMPOSITE CONCRETE FORMWORK PANEL

BACKGROUND OF THE INVENTION

The present invention relates to lightweight concrete formwork panels useful for performing the basic functions of standard concrete forms, but at a significantly reduced weight.

Concrete formwork has traditionally been constructed using High Density Overlay (HDO) plywood and has been connected with steel members. There are also high performance aluminum forms, but these comprise a minority of the market. Normal HDO forms last approximately 20 to 50 pours and aluminum forms will last from 120 to 150 pours. The heavy weights of the standard forms can lead to workplace lifting injuries, slow formwork erection time, the unnecessary use of more than one person to place forms, and high insurance cost for small companies for whom it is necessary buy high risk insurance for their workers.

It would be advantageous if a lightweight, yet durable, concrete formwork were available. The invention will be more readily understood from the following description of a preferred embodiment thereof given, by way of example, with reference to the accompanying drawings.

SUMMARY OF THE INVENTION

The invention is a lightweight concrete formwork panel, suitable for use as a temporary structure or mold for the support of concrete. The lightweight formwork is used while the concrete is setting and gaining sufficient strength to be self-supporting.

In one aspect, the formwork comprises a sandwiched wood composite formwork panel. The composite panel is composed of a lightweight core and a fiber reinforced polymer outer skin. The composite formwork panel is sealed at its' outer edges to prevent moisture uptake.

Lightweight concrete formwork panels are much lighter than the standard HDO form counterparts, yet maintain the same amount of panel stiffness and last well over the current industry standard of 120 to 150 pours. The lightweight composite formwork panels are lighter than the standard counterparts by at least 25 to about 40 percent.

In addition, the lighter, reduced weight of the concrete formwork panels leads to faster erection times of the formwork, saving time and money; a safer work environment by reducing heavy lifting; the freedom for one person to be able to handle a panel instead of using two workers; and, lower risk insurance rates for the employer.

In another aspect, the present invention includes a lightweight concrete formwork panel having a wooden rectangular frame made of perimeter members that include a top member, a bottom member, and opposing side members. The frame also includes a plurality of inner ribs. The perimeter members and inner ribs define openings in the frame. A lightweight core material substantially fills the openings within the wooden frame.

An outer skin reinforcement substantially covers the frame. The outer skin reinforcement includes a layer of a transversely oriented fibrous material and a layer of longitudinally oriented fibrous material. In certain embodiments, the lightweight concrete formwork panel has multiple layers of at least one of the transversely oriented fibrous material and the longitudinally oriented fibrous material.

In certain embodiments, the lightweight concrete formwork panel has perimeter members that have outer edges sealed with a resin to prevent moisture uptake. In other embodiments, the outer edges are chamfered to prevent the outer skin reinforcements from delaminating.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT(S)

In one aspect, the present invention relates to a lightweight concrete formwork panel, suitable for use as a temporary structure or mold for the support of concrete while the concrete sets and gains sufficient strength to be self-supporting. The lightweight concrete formwork panel is an efficient, lightweight and cost effective structure.

Figure 1:
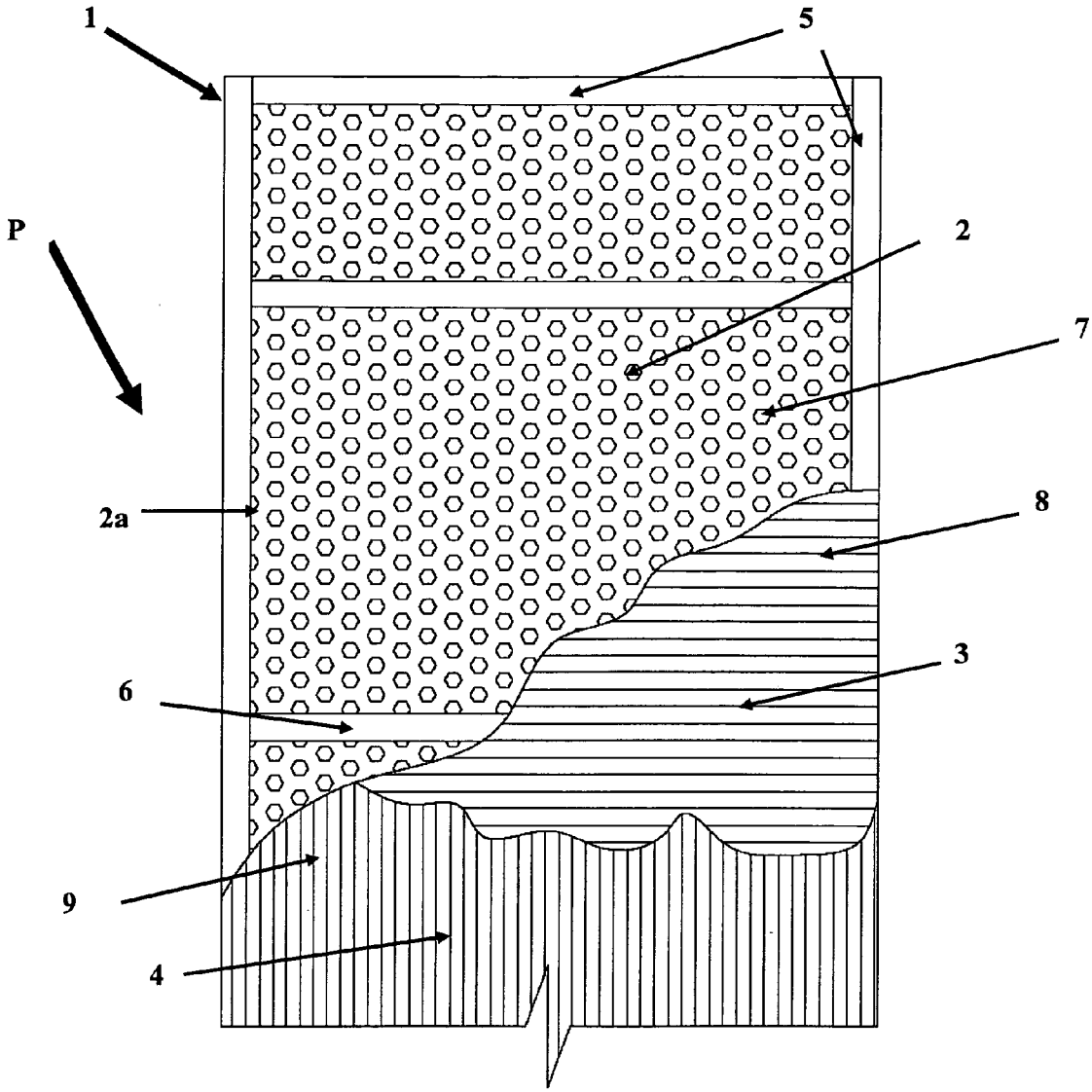
FIG. 1 is a schematic elevation view, partially broken away, showing different layers used in a lightweight concrete formwork panel.

In one aspect, as shown in FIG. 1, the panel structure P includes a wooden frame 1 that is elongated, having a longitudinal axis oriented along its length. The panel structure has a lightweight core 2 and a transverse outer skin reinforcement 3 that contains a predominant amount of reinforcement fibers oriented transverse with respect to the longitudinal axis. The panel also includes a longitudinal outer skin reinforcement 4 that contains a predominant amount of reinforcement fibers oriented substantially parallel with respect to the longitudinal axis. It is to be understood that the frame 1 can be of other structural materials such as metal and composite materials. The lightweight core 2 can be of any suitable lightweight, structurally strong material, such as balsa wood, rigid foam, or honeycomb material.

The lightweight frame 1 and the lightweight core 2 provide a majority of the volume of the panel structure P. The transverse outer skin reinforcement 3 and the longitudinal outer skin reinforcement 4 provide most of the strength and stiffness to the panel P. The transverse outer skin reinforcement 3 and the longitudinal outer skin reinforcement 4 are bonded to the core 2 using a suitable bonding material, such as an adhesive.

The wooden frame 1 is comprised of perimeter members 5 and multiple inner ribs 6. In certain embodiments, the inner ribs 6 are horizontally oriented when the panel structure P is positioned in a vertical orientation where the greater length or longitudinal axis is vertically oriented, as generally shown in the Figures.

The core 2 includes a lightweight core material 7 which is positioned in openings 2*a* between the ribs 6 and the perimeter members 5 of the wooden frame 1.

The transverse outer skin reinforcement layer 3 comprises a substantially transversely oriented fibrous material having transverse fibers 8 which provide strength and stiffness across the width of the panel P. The longitudinal outer skin reinforcement layer 4 comprises a substantially longitudinally oriented fibrous material having longitudinal fibers 9 which provide strength and stiffness in a direction along the length of the panel P, substantially from the top to the bottom of the panel P. Useful fibrous materials can comprise at least one of fiberglass, carbon fibers and Kevlar fibers, which can be impregnated with a thermoplastic or a thermoset resin In the embodiment shown in FIG. 2, the panel P has connection hardware 12 bolted through the inner ribs 6. The connection hardware can be any hardware suitable for connecting the panel to an adjacent panel or to any other structure. The connection hardware can be made of steel, such as stainless steel, or any other suitable material. Optionally, the panel P is sealed along the outer edges 14 with a moisture resistant resin 13 to prevent moisture uptake. Suitable resins include thermoplastic or thermoset resins. Also, the lightweight concrete formwork panel can include outer edges 14 which are chamfered, as shown at 15 in FIG. 2A, to prevent the outer skin from delaminating.

Figure 2:
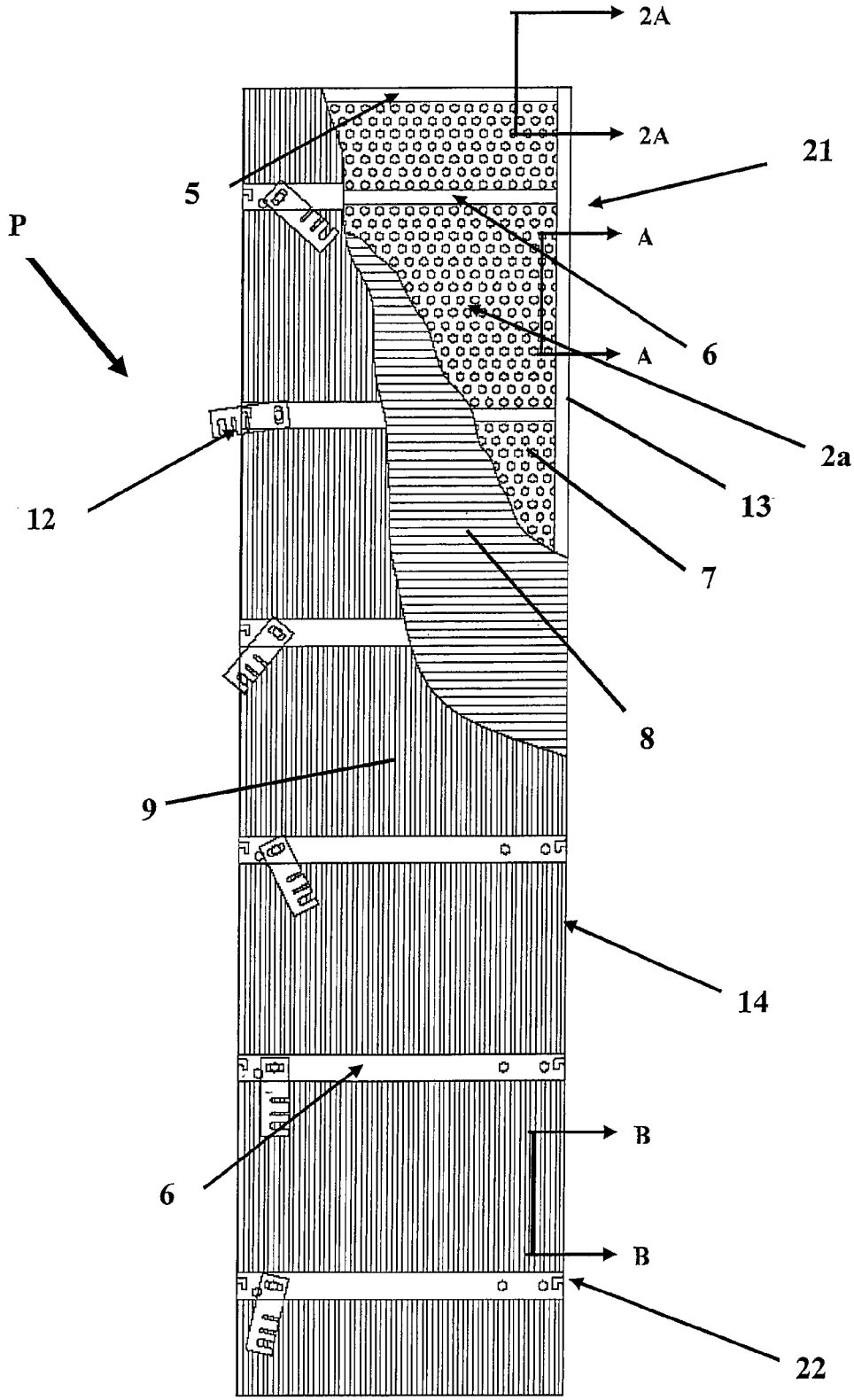
FIG. 2 is a schematic elevation view, partially broken away, illustrating different components of the formwork panel and showing spacing of the mostly horizontal ribs generally coinciding with the connection hardware.
Figure 2A:
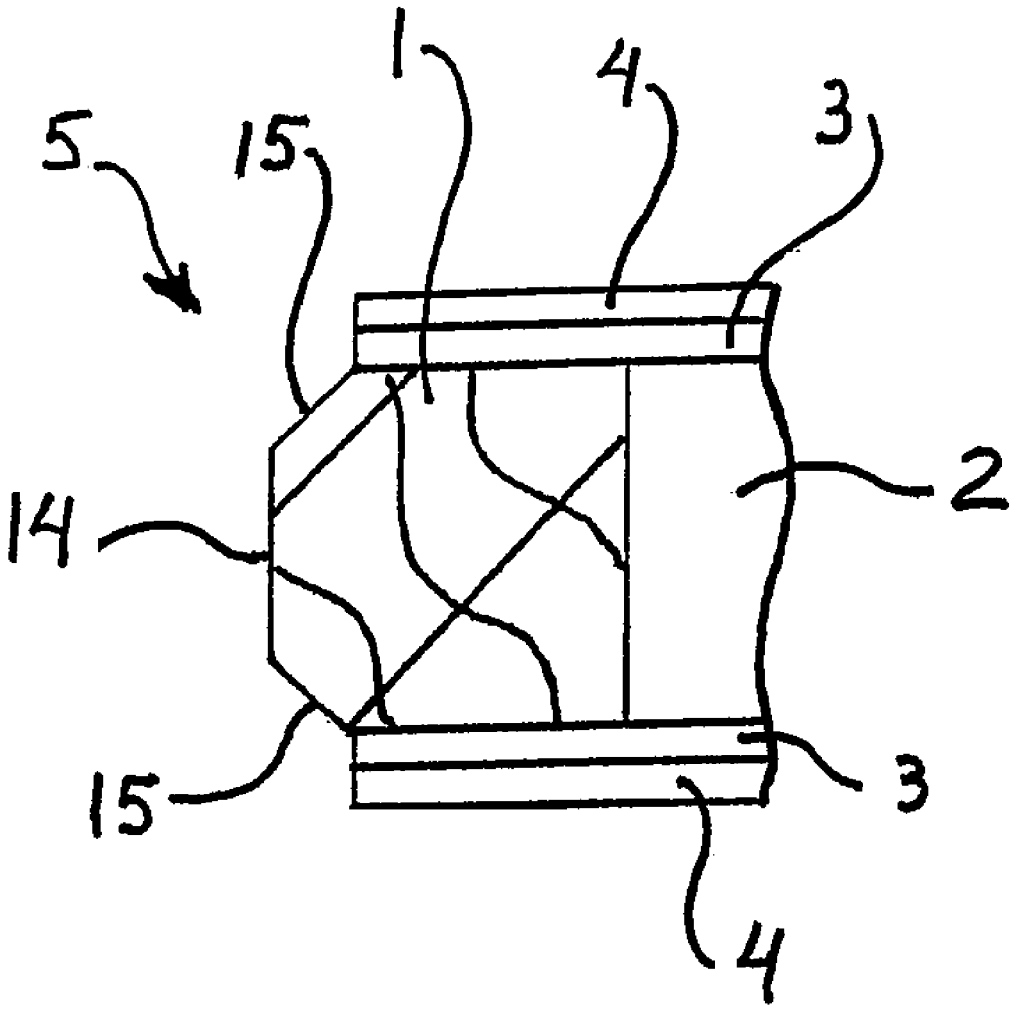
FIG. 2A is an enlarged cross-sectional view of the frame taken along the line 2A-2A of FIG. 2.
Figure 3:
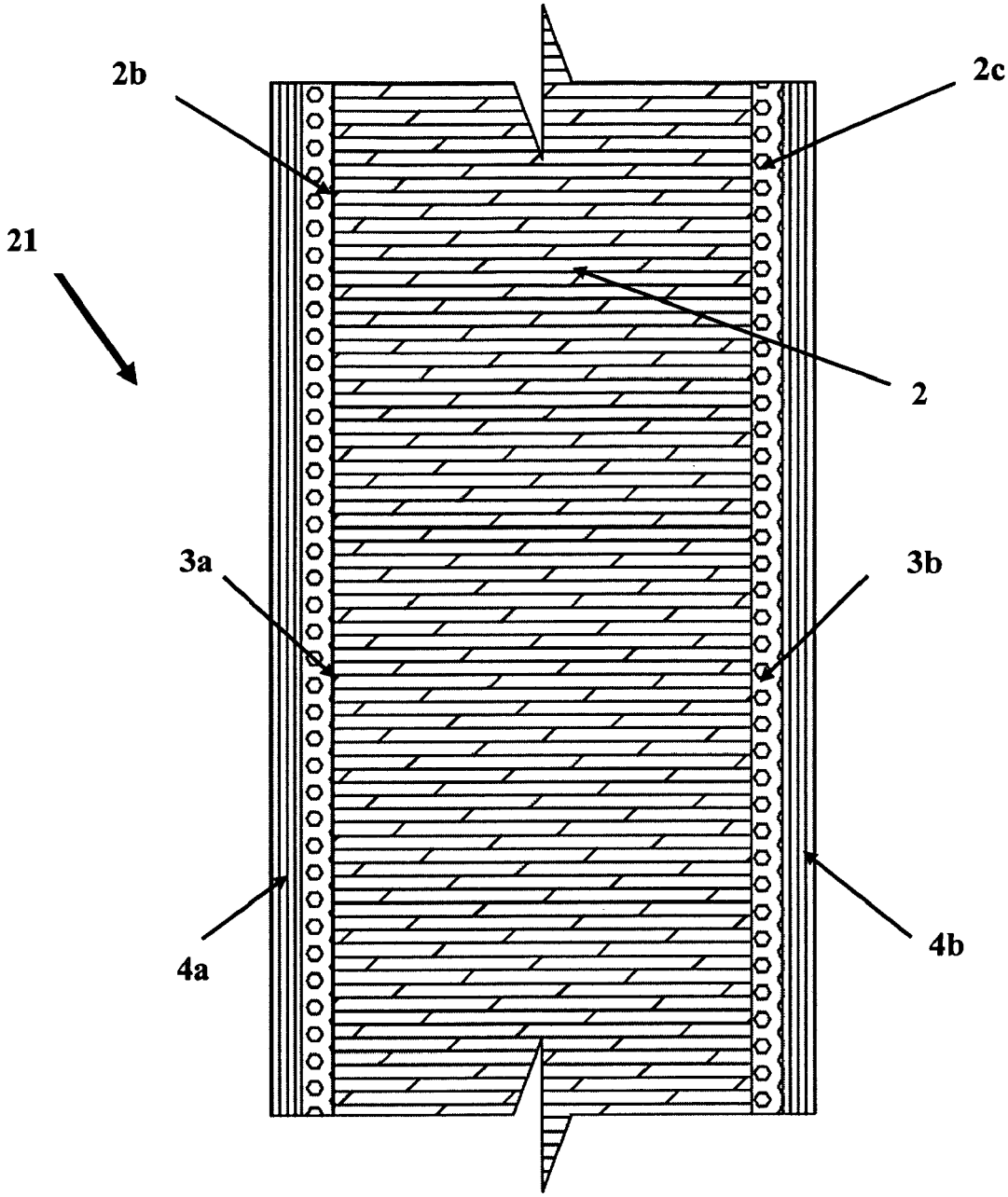
FIG. 3 is the schematic illustration taken along the line A-A in FIG. 2 illustrating the layers of lightweight core and reinforcement layers at a top of the panel.
Figure 4:
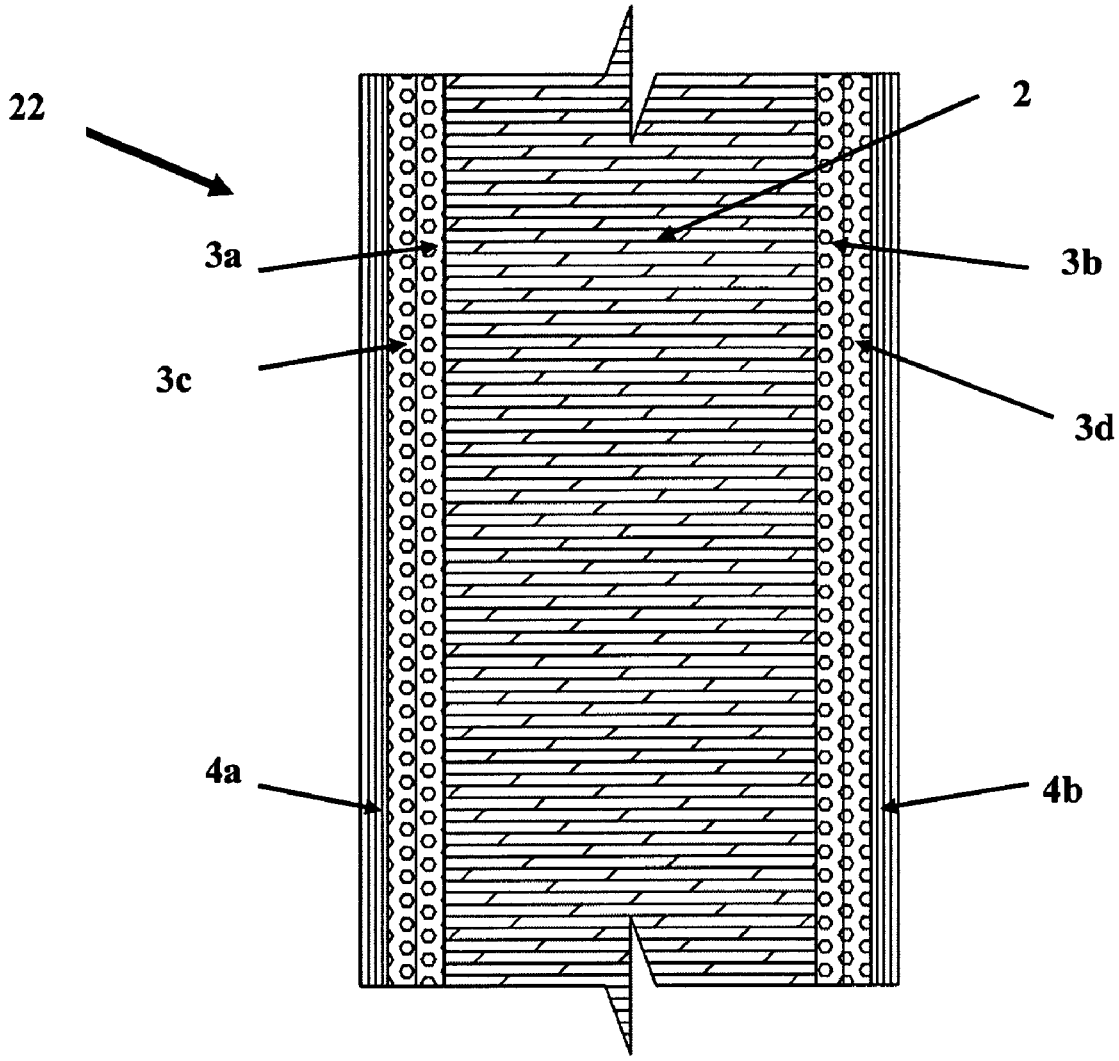
FIG. 4 is a schematic illustration taken along the line B-B in FIG. 2 illustrating the layers of lightweight core with an additional layer of reinforcement at a bottom of the panel.

In the embodiment illustrated in FIGS. 2, 3 and 4, the panel structure P has a top section 21. As shown in FIG. 3, at the top section 21 there is a first transverse layer 3*a* applied to the first side 2*b* of the core 2 and a first longitudinal layer 4*a* applied to the first transverse layer 3*a*. Similarly, at the top section 21 there is a second transverse layer 3*b* applied to the second side 2*c* of the core 2 and a second longitudinal layer 4*b* applied to the second transverse layer 3*b*.

FIG. 4 shows the bottom section 22 of the panel structure P. At the bottom section 22 there is a third transverse layer 3*c* applied to the first transverse layer 3*a*. The first longitudinal layer 4*a* is applied to the third transverse layer 3*c*. Similarly, at the bottom 22 there is a fourth transverse layer 3*d* applied to the second transverse layer 3*b*. The second longitudinal layer 4*b* is applied to the fourth transverse layer 3*d*. The third and fourth transverse layers, 3*c* and 3*d* respectively, provide added strength and stiffness to the lower end which is bottom 22 of the panel P.

Figure 5:
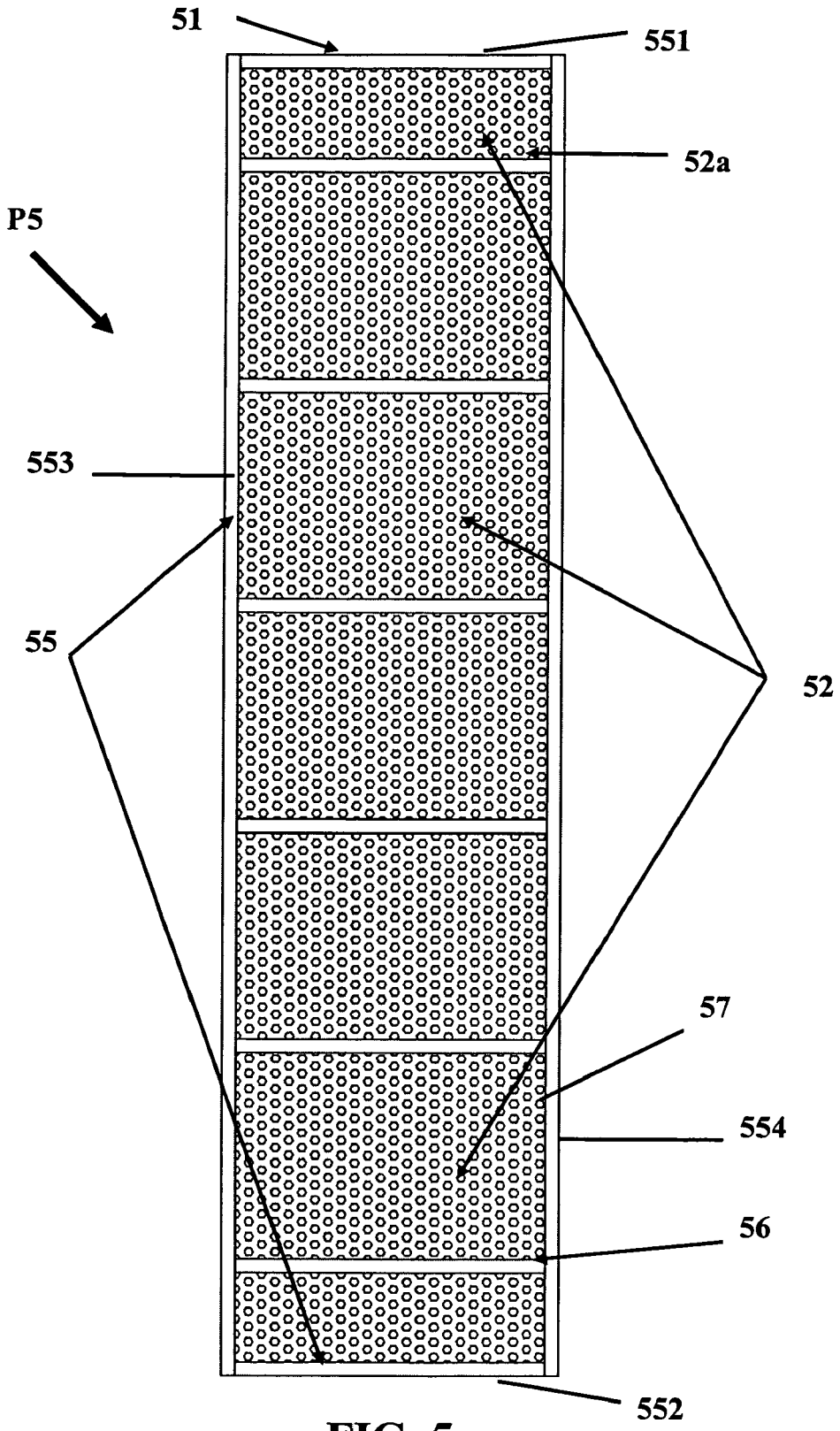
FIG. 5 is a schematic elevation view illustrating a wooden rectangular frame having perimeter members, horizontal ribs, and lightweight core material substantially filling openings within the wooden frame.

In certain embodiments, a panel P5 can be constructed as illustrated in FIG. 5. The panel P5 includes a frame 51 comprised of perimeter members 55, and a lightweight core 52 having a lightweight core material 57 which is positioned in openings 52*a* between ribs 56 in the wooden frame 51. The panel P5 has no variation in the width of the perimeter members 55. The perimeter members 55 include a top member 551, a bottom member 552, and opposing side members 553 and 554. The embodiment shown in FIG. 5 includes multiple inner ribs 56. The perimeter members 55 and the inner ribs 56 define the openings 52*a* in the frame 51. In the embodiment in FIG. 5, the opposing sides 553 and 554 have a substantially uniform width, or thickness, and the inner ribs are substantially normal to the side members 553 and 554. Other configurations can be used.

Figure 6:
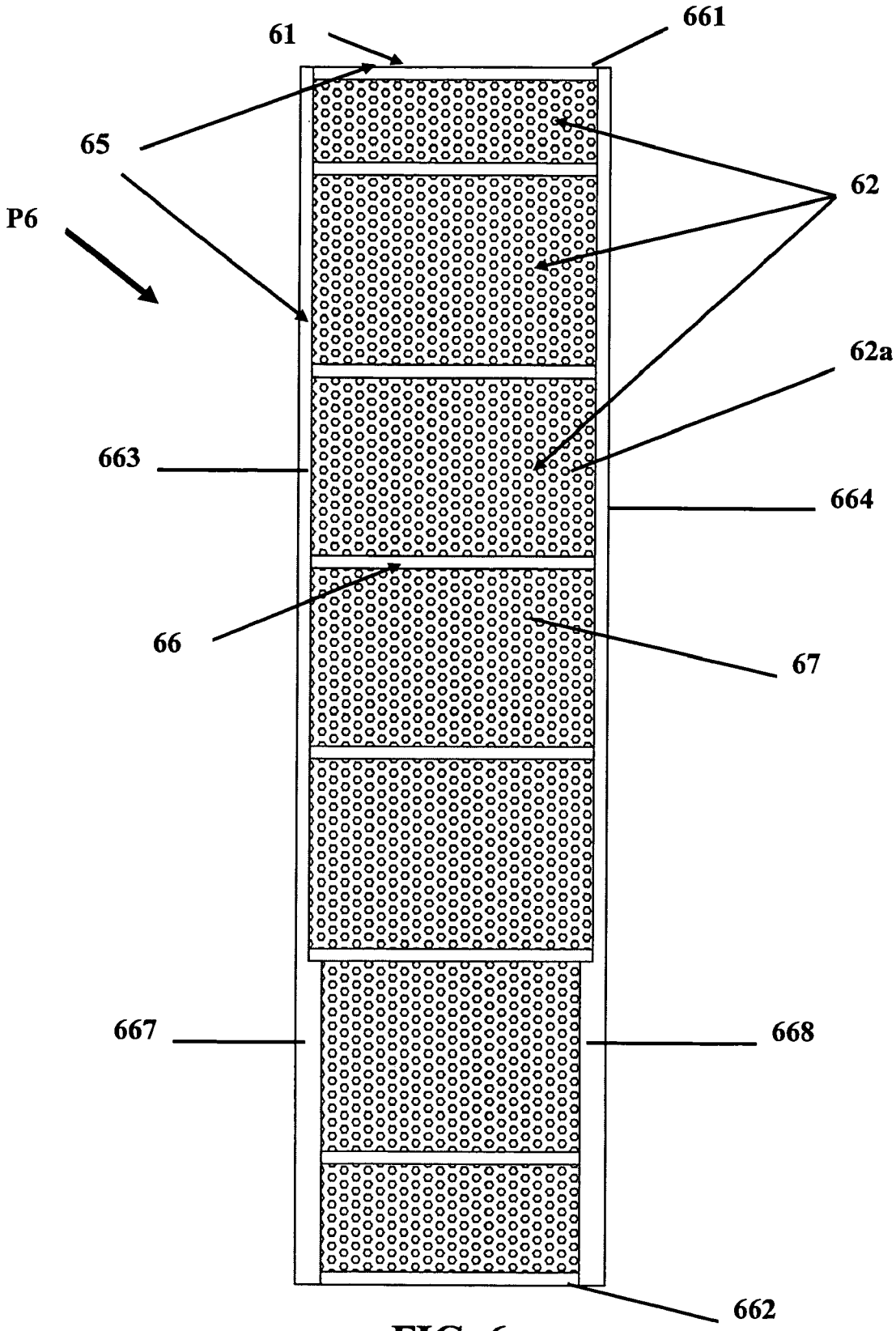
FIG. 6 is a schematic elevation view illustrating a wooden rectangular frame having sides with increased widths at the bottom of the frame and having a lightweight core material substantially filling openings within the wooden frame.

Since, in certain embodiments, the lightweight concrete formwork panel P is subject to hydrostatic loading when the concrete is initially poured, there is need for increased strength at the base of the panel structure P. In another embodiment, a panel P6 can be constructed as illustrated in FIG. 6. The panel P6 includes a frame 61 comprised of perimeter members 65 and a lightweight core 62 having a lightweight core material 67 which is positioned in openings 62*a* between ribs 66 in the wooden frame 61. The perimeter members 65 include a top member 661, a bottom member 662, and opposing side members 663 and 664. The embodiment shown in FIG. 6 includes multiple inner ribs 66. The perimeter members 65 and the inner ribs 66 define the openings 62*a* in the frame 61. In the embodiment shown in FIG. 6 both the opposing sides 663 and 664 substantially have increased thicknesses, or widths, at lower end or bottom sections 667 and 668, respectively. In the embodiment shown in FIG. 6, the bottom sections 667 and 668 are approximately ¼ of the length of the sides 663 and 664. It is to be understood, however, that in other embodiments the bottom sections 667 and 668 can extend to a greater or lesser length, depending on the particular end use application.

Figure 7:
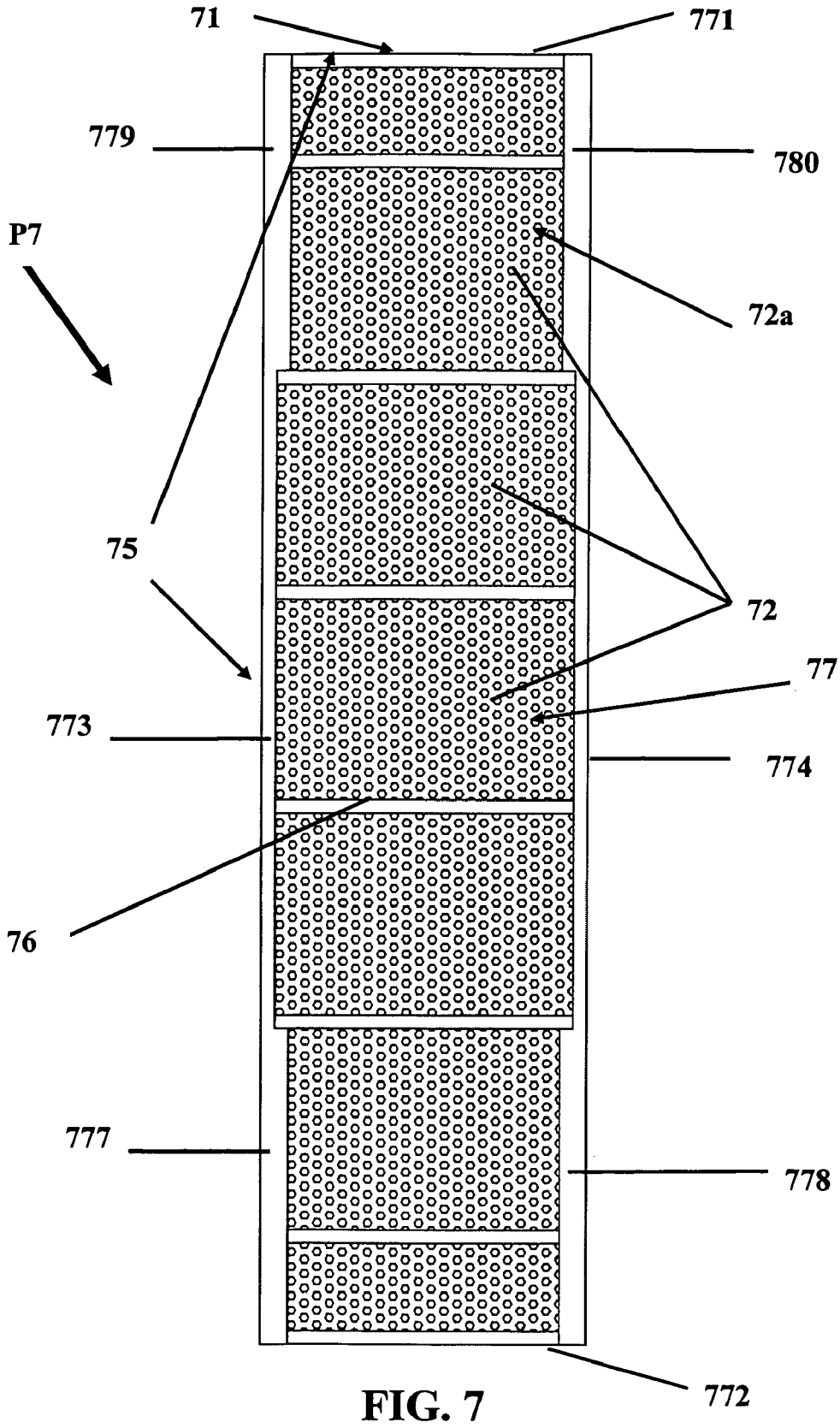
FIG. 7 is a schematic elevation view illustrating a wooden rectangular frame having sides with increased widths at the bottom and the top, and having a lightweight core material substantially filling openings within the wooden frame.

In another embodiment, a panel P7 can be constructed as illustrated in FIG. 7. The panel P7 includes a frame 71 comprised of perimeter members 75, and a lightweight core 72 having a lightweight core material 77 which is positioned in openings 72*a* between the ribs 76 in the wooden frame 71. The perimeter members 75 include a top member 771, a bottom member 772, and opposing side members 773 and 774. The embodiment shown in FIG. 7 includes multiple inner ribs 76. The perimeter members 75 and the inner ribs 76 define the openings 72*a* in the frame 71. In the embodiment shown in FIG. 7 both the opposing sides 773 and 774 generally have increased thicknesses, or widths, at bottom sections 777 and 778, respectively. In the embodiment shown in FIG. 7, the bottom sections 777 and 778 are approximately ¼ of the length of the sides 773 and 774. It is to be understood, however, that the bottom sections can extend to a greater or lesser length, depending on the particular end use application.

Also, in the embodiment shown in FIG. 7, both the opposing sides 773 and 774 generally have increased thicknesses, or widths, at top sections 779 and 780, respectively. In the embodiment shown in FIG. 7, the top sections 779 and 780 are approximately ¼ of the length of the sides 773 and 774, but the top sections can extend to a greater or lesser length, depending on the particular end use application.

It is to be understood that the embodiments shown in FIGS. 5, 6 and 7 are especially useful with the embodiments shown in FIGS. 2, 3 and 4 where the outer skin reinforcements provide more reinforcement at the top sections and/or the bottom sections of the panel.

EXAMPLES

Example I

Weight Comparison of Panel of the Invention Relative to an Industry Standard Panel A conventional concrete pouring form, of the type standard in the industry, has an interior panel with steel connection hardware attached. The industry standard concrete pouring form has a width of 2 feet and a length of 8 feet, and has 6 ribs. This standard panel weighs about 80 pounds. The steel connection hardware for such a 2×8 form weighs about 25 pounds. Thus, the conventional interior panel weighs about 105 pounds.

Weight of Comparative Panel

According to one embodiment of the present invention, the lightweight composite panel P having a 2 feet by 8 feet size and 6 ribs weighs less than about 35 pounds. Adding 25 pounds for the steel connection hardware, the resulting total weight for the lightweight concrete formwork panel is about 60 pounds. This yields a 40% weight reduction in the total weight of the form, as compared to the industry standard, and a 55% weight reduction, as compared to the industry standard, in the interior panel construction.

Example II

Assembly of a Lightweight Composite Panel

In one embodiment of the invention, the transverse and longitudinal reinforcements 3 and 4, respectively, are located on both sides of the exterior of the panel P and enclose a maple frame 1 and a lightweight balsa core 2. The lightweight core is composed of 1 in. thick end grain rigid balsa sheets.

The transverse skin reinforcements 3*a* and 3*b* comprise a fiber reinforced polymer which is applied to the first and second sides, respectively, of the maple frame 1 and the balsa core 2. In certain embodiments, the transverse skin reinforcements comprise an 11 oz/yd$^2$ unidirectional E-Glass fabric which is oriented to provide strength across the width of the panel P.

The longitudinal skin reinforcements 4*a* and 4*b* comprise sheets of fiberglass-reinforced resin or plastic that are applied to the transverse skin reinforcements 3*a* and 3*b*, respectively. In certain embodiments, the longitudinal skin reinforcements 4*a* and 4*b* comprise two side by side 12 in. wide by 0.02 in. thick unidirectional fiberglass laminate sheet materials which extend from the top to the bottom of the panel P to provide strength and stiffness along the length of the panel P.

In certain embodiments, to provide more strength at the bottom of the panel P, the additional layers of the transverse skin reinforcements 3*c* and 3*d* are applied. In certain embodiments, two layers of the 11 oz/yd$^2$ unidirectional E-Glass fabric materials are used instead of one layer on the lower 24 in. of the lightweight concrete formwork panel P.

Example III

Construction of Lightweight Composite Panel

The balsa core 2 and the maple frame 1 are cut to size according to the desired measurements. All connections are butt jointed and secured with standard wood glue. The transverse skin reinforcement, comprising 11 oz/yd$^2$ unidirectional E-Glass fabric material, is cut into ten 24 in.$^2$ sections for the transverse reinforcement. The transverse skin reinforcement is laid out on the balsa core-maple frame wood structure, oriented in the transverse direction with one 24 in$^2$ layer on the upper 6 feet of the panel and two 24 in$^2$ layers on the lower 2 feet of panel and then impregnated with a resin. Useful resins include an FPL-1 Epoxy resin and other epoxy resins. Non-epoxy resins can also be used.

The longitudinal skin reinforcement, comprising 12 in. wide 0.02 in. thick unidirectional fiberglass-reinforced resin or plastic hard laminate sheet material, is cut to 96 in. lengths. The resin impregnated transverse skin reinforcement is covered by the longitudinal skin reinforcement. It is to be understood that the hard laminate sheets comprising the longitudinal skin reinforcements provide a tough exterior and protect the interior balsa core and maple frame wood structure from damage and moisture.

While the invention has been described with reference to various and preferred embodiments, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiment disclosed herein contemplated for carrying out this invention, but that the invention will include all embodiments falling within the scope of the claims.

What is claimed is:

1. A lightweight concrete formwork panel system comprising:

a plurality of lightweight concrete formwork panels, each panel having:

a structural frame having perimeter members and inner ribs, the perimeter members and inner ribs defining openings in the frame, the frame being rectangular and having a longitudinal axis oriented along its length, and the inner ribs extending transversely to the longitudinal axis;

the perimeter members include a top member, a bottom member, and opposing side members, wherein each side member has a bottom section wider than a remaining section of the side member;

a lightweight core material substantially filling the openings within the frame; and first and second outer skins substantially covering the frame and core material, the first and second outer skins each comprising a layer of a fibrous material oriented substantially parallel to the longitudinal axis, and a layer of fibrous material oriented substantially transverse to the longitudinal axis;

wherein the first outer skin defines a first broad face of the lightweight concrete formwork panel and the second outer skin defines a second broad face of the lightweight concrete formwork panel; and connection hardware mounted to an outwardly facing surface of one of the first and second outer skins and to a respective said inner rib, the connection hardware connecting one of the plurality of lightweight concrete formwork panels to an adjacent one of the lightweight concrete formwork panels;

wherein spacing of the ribs of the frame coincides with spacing of connection hardware.

2. The lightweight concrete formwork panel system of claim 1, wherein the frame is a wooden frame.

3. The lightweight concrete formwork panel system of claim 1, wherein the core is comprised of balsa wood.

4. The lightweight concrete formwork panel system of claim 1, wherein each outer skin comprises multiple layers of the substantially transversely oriented fibrous material.

5. The lightweight concrete formwork panel system of claim 1, wherein each outer skin comprises multiple layers of the substantially longitudinally oriented fibrous material.

6. The lightweight concrete formwork panel system of claim 1, wherein the layers of fibrous material comprise a resin reinforced with at least one of fiberglass, carbon fibers and KEVLAR fibers.

7. The lightweight concrete formwork panel system of claim 1, wherein each panel has a bottom and each outer skin comprises two or more layers of fibrous material oriented substantially transverse to the longitudinal axis and applied to the bottom of the respective panel.

8. The lightweight concrete formwork panel system of claim 1, wherein each outer skin comprises two or more layers of the fibrous material oriented substantially parallel to the longitudinal axis and applied to a bottom of the respective panel.

9. The lightweight concrete formwork panel system of claim 1, wherein each panel has a bottom and the outer skin comprises two or more layers of the fibrous material oriented substantially transverse to the longitudinal axis and two or more layers of the fibrous material oriented substantially parallel to the longitudinal axis applied to the bottom of the respective panel.

10. The lightweight concrete formwork panel system of claim 1, wherein the perimeter members include a top member, a bottom member, and opposing side members, wherein each side member has a top section wider than a remaining section of the side member.

11. The lightweight concrete formwork panel system of claim 1, wherein each outer skin comprises two or more layers of fibrous material oriented substantially transverse to the longitudinal axis and applied to the bottom of the respective panel.

12. The lightweight concrete formwork panel system of claim 1, wherein each outer skin comprises two or more layers of fibrous material respective oriented substantially parallel to the longitudinal axis and applied to the bottom of the panel.

13. The lightweight concrete formwork panel system of claim 1, wherein each side member has a top section wider than a remaining section of the side member.

14. The lightweight concrete formwork panel system of claim 13, wherein each outer skin includes multiple layers of the substantially transversely oriented fibrous material and multiple layers of the substantially longitudinally oriented fibrous material.

15. The lightweight concrete formwork panel system of claim 14, wherein the multiple layers of the substantially transversely oriented fibrous material and multiple layers of the substantially longitudinally oriented fibrous material are positioned at a bottom of the respective panel.

16. The lightweight concrete formwork panel system of claim 1, wherein the perimeter members have outer edges sealed with a resin to prevent moisture uptake.

17. The lightweight concrete formwork panel system of claim 1, wherein the perimeter members include outer edges chamfered to retard delamination of the respective outer skin.

* * * * *